US008690466B2

(12) United States Patent
Von Jan

(10) Patent No.: US 8,690,466 B2
(45) Date of Patent: Apr. 8, 2014

(54) WIPER OF PERFORATED SHEET METAL/EXPANDED METAL

(75) Inventor: Martin Von Jan, Schwabach (DE)

(73) Assignee: GEKA GmbH, Bechhofen (DE)

( * ) Notice: Subject to any disclaimer, the term of this patent is extended or adjusted under 35 U.S.C. 154(b) by 404 days.

(21) Appl. No.: 13/082,910

(22) Filed: Apr. 8, 2011

(65) Prior Publication Data

US 2011/0250005 A1 Oct. 13, 2011

(30) Foreign Application Priority Data

Apr. 8, 2010 (DE) ..... 20 2010 004 724 U

(51) Int. Cl.
*A46B 17/08* (2006.01)

(52) U.S. Cl.
USPC ..... 401/122; 401/121

(58) Field of Classification Search
USPC ..... 401/121, 122; 132/218
See application file for complete search history.

(56) References Cited

U.S. PATENT DOCUMENTS

| | | | | |
|---|---|---|---|---|
| 5,180,241 | A * | 1/1993 | Gueret | 401/122 |
| 5,951,185 | A * | 9/1999 | Kingsford et al. | 401/99 |
| 6,568,405 | B2 * | 5/2003 | Masuyama | 132/218 |
| 8,142,093 | B2 * | 3/2012 | Vanoncini | 401/122 |
| 2007/0110500 | A1 * | 5/2007 | Cochran et al. | 401/122 |
| 2012/0128401 | A1 * | 5/2012 | Wilczynski | 401/122 |

FOREIGN PATENT DOCUMENTS

EP 1005806 6/2000

* cited by examiner

*Primary Examiner* — David J. Walczak
*Assistant Examiner* — Jennifer C Chiang
(74) *Attorney, Agent, or Firm* — Setter Roche LLP

(57) ABSTRACT

The invention relates to a wiper for wiping a cosmetics applicator upon withdrawing the same from a storage chamber filled with a cosmetic to be applied, comprising a wiper section and a holding section for fixing the wiper on a storage container, wherein, at least in some areas between the wiper section and the holding section, a functional section is disposed having a screen structure of several passage openings that are disposed immediately next to one another, which connects the storage chamber with the wiper antechamber.

11 Claims, 1 Drawing Sheet

WIPER OF PERFORATED SHEET METAL/EXPANDED METAL

FIELD OF THE INVENTION

The invention relates to a wiper designed for removing or reducing the amount of a cosmetic adhering to an applicator, and to a cosmetics unit equipped with such a wiper.

BACKGROUND OF THE INVENTION

Cosmetics units, and in particular mascaras, consist of a storage container in which a supply of the viscous or almost paste-like cosmetic to be applied is located. This storage container can be sealed with a cap. Most frequently, the cap itself forms a part of the applicator. For this purpose, a slim elongate shaft is generally attached to it, on whose end facing away from the cap (i.e. distal end) a brush is mounted which serves for applying the cosmetic. The brush, shaft and cap together thus form the applicator.

Whenever the cap is placed on the storage container and seals it, the shaft protrudes deeply into the storage container and dips the brush into the supply of cosmetic, whereby the shaft and the brush are being wetted.

When the applicator system is withdrawn, at least the shaft, but generally also the brush, have to be freed from excess cosmetic. This is the only way to prevent the excess cosmetic from dripping off inadvertently and causing stains during use.

For this purpose, a wiper is attached in the area of the opening of the storage container through which the shaft and, in the end, also the brush attached thereto, are pulled out from the storage container.

Such wipers have long been known in many various forms.

A typical wiper is configured as a more or less conical "sleeve" from a rather resilient material, whose smallest sleeve cross-section is slightly smaller than cross-section of the shaft carrying the brush. Thus, the smallest sleeve cross-section rests against the shaft with a certain bias and therefore wipes off a large part of the cosmetic adhering to the shaft when the shaft is withdrawn.

If no special corrective measures are taken, it can hardly be avoided that a negative pressure is created in the storage container by the wiper during the withdrawal of the shaft, because no or not enough air is able to flow into the storage container from the outside which could occupy the space that the part of the cosmetics applicator which has been withdrawn in the interim had previously occupied. In any case, the negative pressure thus created in the storage container abruptly collapses right at the moment when the applicator is about to leave the wiper behind completely. The pressure surge thus created can lead to undesired squirting in the case of a quick withdrawal. Even where this is not the case, it can be observed, in any case, that a bothersome excess of the cosmetic thus collects at the outermost distal end of the brush.

Conversely, an overpressure builds up in the storage container during every relatively quick reinsertion of the mascara brush, because the air displaced by the mascara brush cannot escape quickly enough to the outside along the gap largely provided by the wiper. A certain amount of mascara mass thus tends to be pushed past the wiper into the wiper antechamber (so-called backwiping). The deposits that are thus created in a rather significant extent over time are bothersome.

The above-mentioned effects are particularly pronounced if the user, prior to the actual application of the mascara, withdraws the mascara brush several times to a certain extent and reinserts it, in order to achieve a wetting of the mascara brush that she feels is optimal.

In order to correct this problem, it has been proposed that at least one gap be provided in the actual sealing lip of the wiper, the gap being dimensioned in such a way that the wiper does not seal nearly hermetically anymore, but that air can flow into the storage container. In this case, it is problematic that, only by appropriately dimensioning the free cross-section of the gap, it can be ensured that the at least one gap is not temporarily sealed anyway by the cosmetic building up before the wiper during the withdrawal, thus temporarily affecting the gap's intended function. Such a large gap, however, jeopardizes the sealing function of the wiper, which is not only supposed to wipe, but also to prevent that the cosmetic mass runs into an area behind the wiper from which it cannot be removed anymore by the wiper when the applicator is withdrawn.

In order to solve the problem, it is alternatively proposed in the prior art that a single or a few pressure relief opening(s), which, however, are spaced far from one another, are installed laterally in the area close behind the contact surface of the sealing lip, so that a "bypass" for the air flow is provided, as it were.

However, this approach also involves a trade-off.

Because in the case of one or a few widely spaced pressure relief opening(s) with an only small opening cross-section, there is the danger that every one of these pressure relief openings clogs up relatively quickly with cosmetic, which was inadvertently deposited therein and then dried—this is due to the fact that purely static conditions substantially prevail in the case of a pressure relief opening located in the bypass, which is why such a pressure relief opening is subject to virtually no self-cleaning effect, in contrast to a pressure relief opening directly located in the actual sealing lip, which is exposed to a permanent interplay of forces.

However, in the case of one or a few pressure relief openings with a relatively large cross-section, the problem quickly arises that, at least in the case of unfavorable storage of the cosmetics unit (e.g. in a ladies' handbag in an "upside-down position"), they will nevertheless let cosmetic mass come into the area behind the wiper over time.

Moreover, it is a fact that none of the wipers known so far provides the option that the user can actively reduce a load on the brush serving for the application that is partially or intermittently perceived as being too large, without again having to push the brush through the wiper into the storage container and withdraw it through the wiper again.

In view of this, it is the object of the invention to provide a wiper which reliably prevents a negative pressure or overpressure from building up during the applicator's withdrawal from or insertion into the storage container, without involving the risk that a larger amount of the cosmetic comes into the area behind the wiper, and/or to provide a wiper that enables a specific reduction of the load, as is described above.

SUMMARY OF THE INVENTION

This object, namely to improve the pressure equalization and/or to enable a specific load reduction, is accomplished with a wiper for wiping a cosmetics applicator upon withdrawing the same from a storage chamber filled with the cosmetic to be applied, comprising a wiper section and a holding section for fixing the wiper on a storage container, wherein, at least in some areas between the wiper section and the holding section, a passage section is disposed which has a screen structure of several passage openings that are disposed immediately next to one another, which connects the storage chamber with the wiper antechamber.

Such a screen structure can consist of a plurality of passage openings, each of which is as such so small that the cosmetic mass is substantially not able to overcome the passage openings and to come from the storage chamber into the area of the wiper antechamber even in the case of an unfavorable storage of the cosmetics unit (for example upside-down). However, since a plurality of such passage openings is provided, the total result is a large pressure equalization cross-section by which the required pressure equalization is reliably ensured. Given an appropriate dimensioning of the passage openings, the user is additionally given the option of carrying out a specific reduction of the load, as will be described later.

Preferably, the passage section is formed so thin-walled in the area thereof forming the screen structure that substantially no cosmetic mass can deposit in the passage openings. To conjure up an image, the wall thickness in the area of the screen structure is so small that the passage opening does not have a reveal anymore on which a bothersome amount of cosmetic mass could deposit, that is, the passage opening, viewed up close, presents itself as an aperture and not as a pipe.

Within the context of another preferred embodiment, it is provided that the passage section is made from such a rigid material that the screen structure is substantially not deformed under the influence of the forces occurring upon withdrawal of the applicator. In this way, it would become possible for the brush, when wiping past the screen structure, to brush it off and thus, to counteract a gradual clogging of the screen structure and/or to achieve a specific reduction of the load by the brush being pulled or turned closely past the screen structure from the passage openings on the side of the wiper antechamber, whereby a part of the load of the brush would be pulled off or "scraped off" by these passage openings. In this manner, excess mascara may possibly be conveyed back into the storage container, which after the withdrawal is first located on the distal end face of the bristle-bearing core. This excess is wiped off on the outermost edge of the storage container, so that the excess mass is at first again located in the margin area of the wiper antechamber. From here, this excess mass can possibly be "brushed" or pushed back through the passage section into the storage chamber during the reinsertion of the brush.

In this case, it is conceivable to provide the passage openings with a profile supporting this "scraping", namely, for example, with a scraping or cutting profile as it is basically known from a finely and multiply perforated vegetable or parmesan slicer—the individual openings in such household appliances are often provided with an appendage which protrudes pocket-like in an outward direction and shaves off fine slices from said vegetable or cheese and ejects this slice on the side of the slicer facing away from the vegetable or cheese. Of course, such a profile would be configured less aggressively in a cosmetics applicator than in a "vegetable slicer", namely so as not to destroy the brush prematurely.

Preferably, the section forming the screen structure is made from a different material from the wiper section or at least the part thereof producing the actual wiping effect. This makes it possible to select, for each of the separate parts, a material optimally adapted to the function of the respective component. In particular, a metal or hard plastic can be used for the passage section in this case, which is optimal for forming an extremely thin-walled screen structure which is nevertheless rigid in itself.

Preferably, the passage section, or at least the screen structure formed by it, consists of metal, ideally of stainless steel.

Within the context of a preferred embodiment, it is provided that the passage section consists of a metal sleeve which is preferably conical and preferably closed in itself in the circumferential direction. Where such a metal sleeve has been rolled or roll-bent from a plane perforated sheet metal or expanded metal, the joint is tacked by at least one welding spot so that the sleeve maintains its round shape reliably. Such a metal sleeve facilitates assembly immensely, because it can be overmolded or pressed in or snap-locked in its final position.

Preferably, the screen structure comprises passage openings which are disposed in the circumferential direction along a joint center line one behind the other, and/or disposed in the longitudinal direction along a joint center line one behind the other.

Within the context of a particularly preferred embodiment, it is provided that the passage section consists of expanded metal, preferably from an expanded metal formed into the shape of a sleeve. This permits an extremely rational configuration of an ideal screen structure with a plurality of passage openings, namely ideally more than 50 passage openings, which is generally optimal for any wiper according to the teaching of the invention.

Preferably, the individual passage openings—seen in the direction perpendicular to the longitudinal axis of the sleeve—each have a free opening cross-section whose surface area, with regard to its amount, corresponds to the surface area of a circle having a diameter of ≤3 mm, preferably ≤1 mm, and ideally ≤0.75 mm, as well as >0.15 mm. This is a good harmonization of tightness and low tendency to clog.

For the same reason, it is preferably ensured that passage openings disposed substantially next to one another in the circumferential or longitudinal direction are respectively separated from one another only by a very narrow web, namely a web whose surface area is smaller than the free cross-sectional surface area of a single passage opening, preferably by the factor 1.5, and ideally by the factor 2.

Preferably, attention is paid to the width of the web at the narrowest parts of the web between two adjacent openings not becoming smaller than the thickness of the metal sheet used for the production of the perforated sheet metal or expanded metal by subsequent perforation or expansion.

Within the context of another preferred embodiment, it is provided that the screen structure consists of the plurality of individual passage openings which are disposed immediately next to one another and separated only by webs, wherein the cross-sectional surface area of the passage openings and the dimensions of the webs are selected such that, if the cross-sectional surface areas of the individual passage openings are added up and if the surface areas that the individual webs have on the outer circumference are added up, the total cross-sectional surface area GQF makes up 20% to 70%, preferably up to 60% of the total web surface area GSF.

The object specified in the introduction is furthermore achieved with a cosmetics unit equipped with a wiper according to the invention.

It should be noted that, as a modification, protection is also sought for a wiper, which, though it has only a single or at least two passage openings, respectively, at one or several places instead of a screen structure, it is, however, characterized by such a small wall thickness and/or metallic wall as it is described in more detail by the description of the exemplary embodiment.

Further advantages, mechanisms of action and optional embodiments become apparent from the following description of the exemplary embodiments supported by the Figures.

DETAILED DESCRIPTION OF THE PREFERRED EMBODIMENTS

Figure 1:
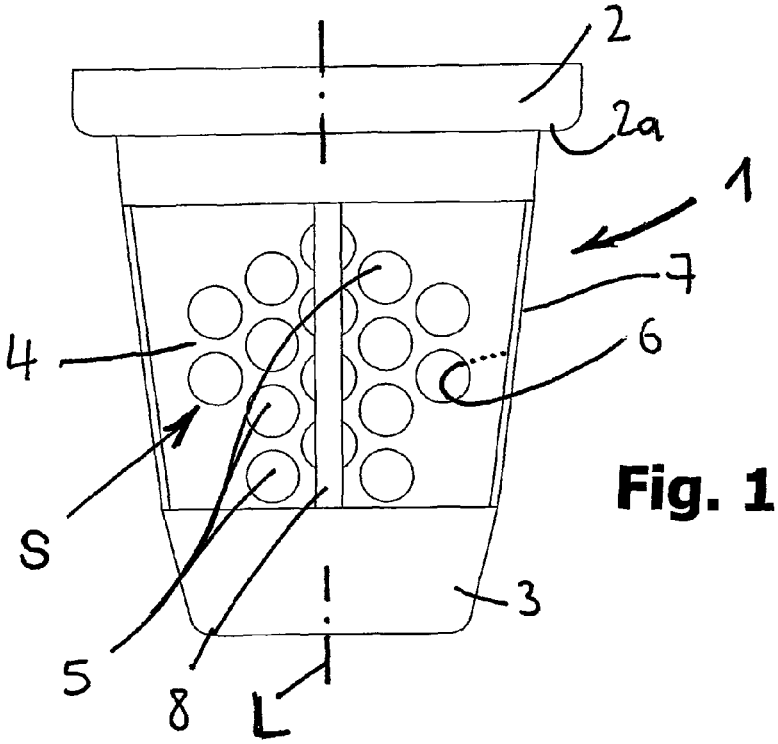
FIG. 1 shows a first exemplary embodiment of a wiper, the passage section of which consists of a separate sleeve into which a screen structure in the form of a perforation is incorporated in two zones respectively disposed at an angle of 180°.

FIG. 1 shows a first exemplary embodiment of the wiper 1 according to the invention. The wiper 1 consists of a holding section 2, a wiper section 3 and a passage section 4.

The holding section 2 and the wiper section 3 are most frequently configured in an annular shape, i.e. closed in itself in the circumferential direction. The wiper section 3 consists of a resilient material. Generally, it is designed such that it rests against the shaft of the applicator with a certain bias, preferably along a contact line closed in itself over its surface in the circumferential direction, so that a sealing action that is as comprehensive as possible is provided in the area of said contact line, so that, therefore, no perceptible pressure equalization can take place through the contact line. In exceptions, however, the contact line can have local interruptions without the advantage according to the invention being abandoned completely thereby.

The holding section 2 preferably has a protruding shoulder 2*a* extending over its entire circumference, by means of which it is fixed in a corresponding seat of the storage container (most frequently by force fit or frictional fit), so that the wiper remains on the storage container even if the applicator is withdrawn in a careless manner.

The wiper section 3, or at least the part of the wiper section 3 immediately resting against the stem and wiping the latter, will often be fabricated from a soft elastic material, that is, most frequently from a material that has "rubber-like resilient" properties, such as NBR, or from an elastomeric material. In a number of cases, however, a harder material can also be used, for example LDPE or a comparably yielding material. In the present exemplary embodiment, one development is selected as a lip seal which rests against the stem substantially under flexional bias.

The holding section 2 is configured such that it has a seat by means of which it can be fixed with an exact fit into a correspondingly designed receiving flange of the storage container. Preferably, as also in this exemplary embodiment, the holding section 2 is also fabricated from a soft elastic material, that is, most frequently from a material that has "rubber-like resilient" properties, or from an elastomeric material, or LDPE or a comparable material. Especially if soft elastic material is used, the holding section 2 can readily also act as a gasket with which it is ensured that the cap seals the storage container in a leak-proof manner when the cap is attached to the storage container. For this purpose, the holding section 2 will generally be configured and mounted such that it is exposed to a compression in the axial direction of the storage container when the cap is put on the storage container in the closed position.

A passage section 4 is provided between the holding section 2 and the wiper section 3, seen along the longitudinal axis L of the wiper 1. Preferably, the passage section is advantageously designed as a separate part, but may in individual cases also be an integral component of the part forming the wiper section and/or the holding section. Preferably, this passage section can be formed from a preferably more rigid or harder material different from the material of the holding section and/or the material of the wiper section. Moreover, this passage section 4 can be configured so as to extend completely around the wiper in the circumferential direction, as in this exemplary embodiment. This type of configuration is preferred since it has advantages with regard to the fabrication process, as will become recognizable in more detail below.

So far as this can be dispensed with, and if a greater fabrication effort is acceptable, it may also be so that the passage section (4) (seen in the circumferential direction of the wiper 1) only takes up at least a single area also limited in the circumferential direction, whereas on the same level, seen in the circumferential direction, other areas also exist through which a direct connection is realized between the holding section 2 and the wiper section 3. The passage section 4 is then realized in the form of one or more plates which are correspondingly curved in the circumferential direction and into which corresponding windows are inserted that open up between the wiper section 3 and the holding section 2.

The passage section 4 comprises several passage openings, each of which connect the interior of the storage container 1 accommodating the cosmetic provided for application with the wiper antechamber 6—with the term wiper antechamber denoting that imaginary chamber which, for example when the stem is withdrawn through the wiper 1, is enclosed between the above-mentioned contact line and that imaginary plane that is spanned by the outermost opening of the holding section 2 on the side thereof facing away from the wiper section.

The side of the wiper 1 facing away from the wiper antechamber 6 is referred to as the storage chamber side 7 of the wiper; this is just for the sake of completeness. The storage chamber side 7 of the wiper, when the wiper is mounted in the storage container as intended, seals the opening of the storage container.

On their own, each of these passage openings 5 only has a small opening cross-section, that is, preferably an opening cross-section whose surface area, with regard to its amount, corresponds to the surface area of a circle having a diameter of less than 3 mm or 2 mm, and ideally of less than 1 mm. In the present exemplary embodiment, this opening cross-section has been selected to be even slightly less and is, with regard to its amount, less than the surface area of a circle having a diameter of 0.8 mm. In many cases, a further reduction of the diameter down to 0.5 mm may also make sense. If the passage openings are to act solely as pressure relief openings, in some cases, that is, preferably, the fact that it is useful to keep the diameter as small as possible applies, taking into consideration the statement in the following sentence—significantly smaller than the hitherto known singular pressure relief openings. The lower limit for the diameter is determined by the tendency of the individual cosmetic to permanently clog the pressure relief openings, as well as by the cleaning action that the individual brush exerts on the pressure relief openings. It is expedient to keep the pressure relief openings just small enough for a single bristle to be able to penetrate a single pressure relief opening.

Another aspect must be taken into account if the passage openings are substantially supposed (also) to act as openings that enable a specific reduction of the load of the brush. This refers to the possibility of pushing an excess of the cosmetic mass adhering to the bristles through the pressure relief openings 5 back into the storage chamber by means of the bristles—for this purpose, a pushing-wiping movement is carried out along the pressure relief openings with the brush, which moves a part of the excess cosmetic mass through the pressure relief openings. It is evident that especially the diameter limit for such a load reduction is greatly dependent upon the properties (e.g. the viscosity) of the cosmetic mass and the brush, and that it can therefore only be determined exactly and only for the individual case by means of a manageable number of experiments. In view of this, it is not permissible to provide an abstract general specification in figures.

If such a load reduction is to be made possible, the opening cross-section of the individual passage openings should be given large dimensions, with the upper limit being determined by the necessity of the opening cross-section having to remain so small that substantially no cosmetic can come from the storage chamber through the passage openings into the wiper antechamber 7, but that—by using the brush—transport is only possible in the reverse direction. In particular in order to ensure such a load reduction, the diameters specified above for the case of pressure equalization are preferably adhered to for the passage openings, provided, however, that diameters of less than 0.2 mm are avoided in any case, most frequently less than 0.5 mm, and better still less than 0.75 mm.

In view of all this, the passage section 4 is provided with not only one or two passage openings 5, but with a screen structure S of passage openings. In this case, a screen structure S of passage openings is understood to be, in the simplest, most undemanding case, a collection of at least three, better at least four or at least five passage openings located immediately next to one another, which are preferably disposed in accordance with the pattern that the corresponding number on a dice shows. The effect according to the invention can thus be achieved at least to some extent, even if only rudimentarily at first. Significantly better results can be obtained if the screen structure consists of a host of at least twelve passage openings located immediately next to one another. For a perfect result, a total of more than 30 or even 45 passage openings are provided.

In this case, it is not mandatory that the passage openings are disposed such that they form a really uniform or "geometrical" pattern following a mathematically transcribable rule, even if such an arrangement is clearly preferred. In principle, it would also be conceivable to arrange the passage opening closely spaced but irregularly, such as like a screen-like but completely irregular pinhole pattern. What is important, however, it that only narrow webs, respectively, within the sense to be defined below remain between the passage openings.

Two passage openings disposed substantially next to one another in the circumferential or longitudinal direction are respectively separated from one another only by a very narrow web, namely a web whose surface area is smaller than the free cross-sectional surface area of a single passage opening. Preferably, the surface area of said web is smaller than the free cross-sectional surface area of a single passage opening, by at least the factor 1.5 or better still by a factor of at least 2.

The inventive screen structure of a plurality of individual passage openings which are disposed immediately next to one another and separated only by webs can alternatively also be defined also by means of the ratio of the total web surface area GSF to the total cross-sectional surface area GQF. Preferably, $GSF/GQF \leq 4$ applies. Selecting a $GSF/GQF \leq 1$ is significantly more beneficial. In this case $GSF/GQF \geq 0.5$ preferably applies. The calculation of GSF and GQF is carried out generally by imaginarily tightening a rope about all those passage openings that form the edge of the screen structure, thus supporting the imaginary rope line. The surface areas lying within the imaginary rope line are taken into account in the calculation.

In summary, it can be said that the screen structure consists of passage openings, each of which as such has such a small cross-sectional surface area that the cosmetic located in the storage container is not able in a substantial extent to overcome the respective passage opening or to pass over from the storage chamber into the wiper antechamber defined above, due to its viscosity and/or surface tension—even if the cosmetics unit is stored, for example, upside-down, so that cosmetic mass after some time collects on the storage chamber side 7 in front of the passage section 4.

According to the invention, the passage section 4 or at least the part thereof forming the screen structure is configured to be very thin-walled. Its wall thickness is, at least in the area of the passage openings, 0.75 mm, preferably 0.5 mm. Where plastic is used for forming the screen structure, the wall thickness can, in certain cases, be 1.2 mm, better only up to 1 mm.

In the process, attention is to be paid that the screen structure is still rigid in itself, that is, that, under the influence of the forces the bristles exert on it, it does not yield to such an extent that the bristles cannot fulfill their cleaning function anymore, which is to be described in more detail below.

By way of exception, a flexible screen structure configured like a foil is also conceivable, for example a comparably hard Mylar foil held or supported so as to be spanned open all around by a window between the holding section and the wiper section and having a number of passage openings.

In the present exemplary embodiment, the passage section 4 is made of metal, preferably of stainless steel, and therefore has an even smaller wall thickness—the wall thickness in this case is 0.35 mm or less.

Under functional aspects, it can be said that the wall thickness is supposed to be selected so as to be as small as possible, taking into account the functional considerations specified below.

The minimum wall thickness is determined, on the one hand, taking into account aspects relating to strength. For the passage section 4, or its screen structure, have to be able to withstand the forces occurring during the withdrawal and wiping of the applicator as well as during the reinsertion of the applicator without being deformed substantially or in a manner affecting its function. However, this is not yet sufficient, because the reason for the thin walls according to the invention is the following:

In view of the fact that the cosmetic mass, due to its viscosity and/or inherent tension, cannot overcome the passage openings 5, which are selected to be sufficiently small, from the storage chamber side 7, and therefore gains virtually no access to the wiper antechamber 6 through the passage openings 5, the wall thickness does not play any substantial role.

However, a wall thickness that is as small as possible is of interest in order to ensure that the passage openings 5 do not clog up and are thus affected in their function, e.g. their pressure equalizing function. However, a wall thickness that is as small as possible is also of interest in order to accomplish a specified load reduction. For such a load reduction works in a satisfactory degree only if the cosmetic pushed back in or through the passage openings by the bristles does not "get caught" in the passage openings, i.e. in their reveal, thus clogging the passage openings, but that it is immediately "extruded" from out of the passage openings on the side of the storage chamber, or even pushed into the storage chamber by the bristles sliding through the passage openings, and then "creeps back" to the supply at least over time.

This is accomplished, on the one hand, by the reveal of the pressure equalizing surfaces, i.e. the extent of the passage openings perpendicular to their cross-sectional surface area, being so small or narrow that virtually no cosmetic mass can deposit a priori in the passage openings.

On the other hand, the wiper 1 configured according to the invention also makes use of the cleaning action of the brush of the applicator—when the brush is pulled or pushed through the wiper antechamber 6 during withdrawal or reinsertion, then its bristles "brush" along the screen structure of the passage section 4. In the process, they "poke" the passage openings clear, even if no intended load reduction in the above-mentioned sense is being carried out. In practice, however, this only works in a satisfactory degree if the passage section in the area of the passage openings is configured sufficiently thin-walled—namely so thin-walled that the bristles do not simply push the cosmetic mass tending to clog the passage openings deeper into the passage openings 5 and leave it there, but are actually able to push it out from the passage openings or are capable of "poking through" the cosmetic mass deposited in the passage openings.

How thin the wall thickness of the passage section is to be selected minimally, depending on the consistency of the individual mascara mass, the properties of the brush used in the individual case and the selected diameter of the passage openings, in order to accomplish this effect can hardly be put into figures in a universally applicable way, but can be determined for the individual case by experiments common in the field.

As is shown in FIG. 1, the wiper 1 is configured such that it tapers from the holding section 2 in the axial direction towards the wiper section 3, that is, has a diameter decreasing at least in some sections towards the wiper section. This ensures that the passage openings 5 on the storage chamber side 7 do not rest against the wall of the storage chamber or form too narrow a gap with the wall of the storage container which could be diverted in a function-impairing way by cosmetic mass that sticks in the gap over a longer period of time.

The wiper shown by FIG. 1 is produced as follow and designed accordingly:

The passage section is produced from a metal sheet which is provided, preferably still in the plane condition, with a matrix of passage openings and is then processed to form a circular-conical sleeve closed in itself. The passage openings do not necessarily have to be machined but preferably can also be produced by simple perforation with suitable pointed tools. During the further use, attention then has to be paid that the burr created on the finished wiper by such a material displacement process comes to lie on the storage chamber side 7 so as to preserve the bristles. If expanded metal is used, it may be expedient to dispose the punch burr, which is only very fine there, on the wiper antechamber side in order to have a rougher surface available for cleaning the brush.

The circular-conical sleeve thus created is inserted into a corresponding mold. Then, preferably in a single injection-molding process, the holding section 2 and the wiper section 3 are injection-molded on the passage section 4 in the form of said metal sleeve. A permanent connection between the holding section 2 and the wiper section 3 on the one hand and the passage section 4 on the other hand is thus obtained.

In many cases, it will be expedient to provide the passage section, in the area in which it is overmolded, i.e. where the plastic material of the holding section and/or the wiper section flows around it, with one or several holes, openings or projections or recesses which are filled or embedded by the still molten plastic mass, which even accomplishes an anchorage in a positive fit between the plastic and the sleeve.

In order to injection-mold the wiper section 3 and the holding section 2 in single process step without having to resort to an increased effort for supplying plastic, the wiper 1 has at least one web 8 spanning over the passage section 4 from the holding section 2 to the wiper section 3. Generally, it is not just one web that is provided, but rather, it is expedient that at least three such webs 8 are disposed distributed over the circumference.

As long as the plastic mass is still molten, such a web 8 serves as a duct for feeding, compensating and/or venting the plastic melt from the holding section 2 to the wiper section 3 and/or vice versa.

Such a web 8 or these webs 8 in many cases not only simplify fabrication but, also or instead, make sense under aspects relating to strength. Given suitable dimensions, these webs 8 in the end constitute tie anchors between the wiper section 3 and the holding section 2. Even in unfavorable circumstances (in particular when the passage section 4 consists of a material that does not form a particularly good adhesive connection with the plastic during the overmolding process) a tie anchor prevents the passage section being pulled out of its embedment in the plastic of the holding section 2 and/or the wiper section 3 when relatively large tensile forces occur in the longitudinal direction of the wiper, for example when the applicator is reinserted into the storage container. This is particularly important if no additional preparations have been made in order to prevent the composite from detaching, such as the openings etc. in the passage section already described above, which are filled with the plastic mass during overmolding and then offer purchase by positive fit.

Figure 2:
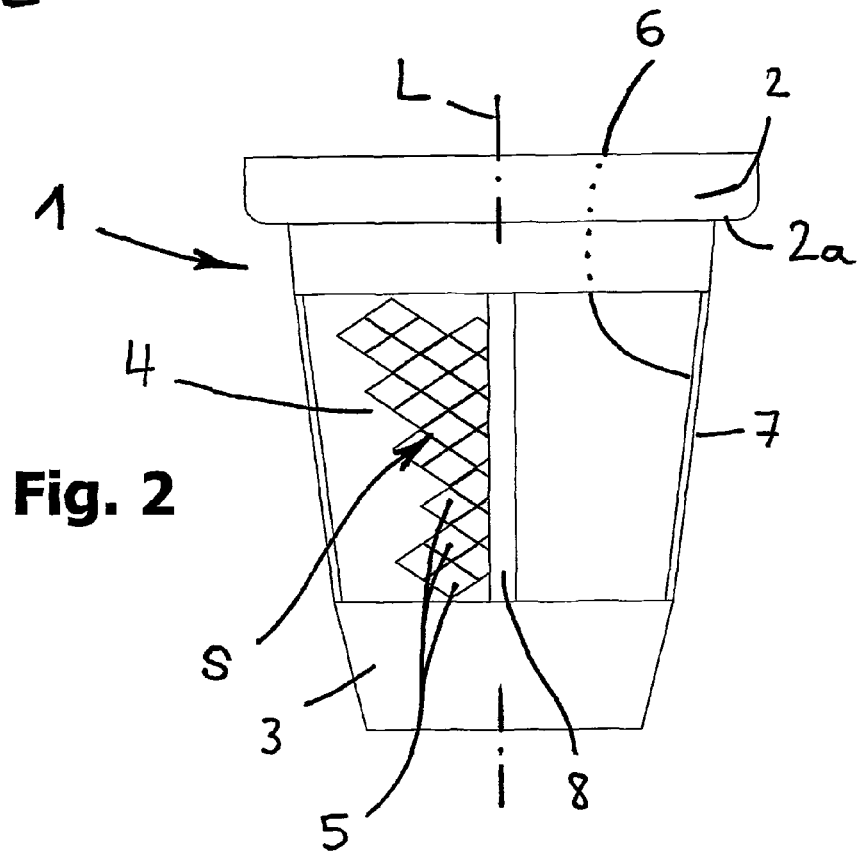
FIG. 2 shows a second exemplary embodiment of a wiper, the passage section of which consists of a separate sleeve of expanded metal.

FIG. 2 shows a second exemplary embodiment of the invention. This only differs from the above described first exemplary embodiment by the passage section being made from expanded metal instead of a perforated metal sleeve. Therefore, the statements above pertaining to the first exemplary embodiment wholly apply mutatis mutandis to the second exemplary embodiment unless otherwise presented by the following explanations or the clear illustration in the Figure.

In this second exemplary embodiment, the metal sleeve with the screen structure of closely spaced passage openings 5 is produced as follows and is also configured accordingly.

In the still plane state, a thin metal sheet is provided with a plurality of cuts arranged substantially parallel relative to one another. The cuts are generally pushed through, still in the same process step, by the wedge-shaped prong, whereby the sheet is stretched substantially in its main plane, so that the webs remaining between the cuts are plastically deformed and the subsequent passage openings open up between these webs. A short metal sleeve, which is generally completely closed in itself with the exception of a small gap in the longitudinal direction, and which preferably has a conical shape, preferably a circular-conical shape, is formed from this expanded metal, most frequently following the stretching process. Said gap is usually accepted since the expanded metal is difficult to weld with a continuous seam and it is therefore uneconomical to attempt to produce a completely closed sleeve. However, the gap is preferably kept closed by at least one local welding spot.

The cross-sectional surface area of the individual passage openings formed in this expanded metal can be very easily set by means of the length of the cuts of the expanded metal and its degree of expansion, as well as by the distance between the cuts which determines the dimension of the webs that later remain between the individual passage openings.

It must also be remarked that it is also conceivable that the metal sleeve thus produced has the shape of a cone that is not perfectly circular in the circumferential direction, but polygonal instead. Instead of a conical contour, a cylindrical contour could also be conceived of secondarily, if the diameter is correspondingly reduced relative to the adjacent wall of the storage container, and if the advantage of the cone facilitating the reinsertion of the brush is relinquished. Coincidentally, both points also apply to the first embodiment.

A third exemplary embodiment of the invention not illustrated in a Figure optionally corresponds to the first or second exemplary embodiment of the invention, which is why the statements there respectively also apply without qualification to this third exemplary embodiment unless otherwise expressly stated below.

The difference of this third exemplary embodiment to, for example, the first exemplary embodiment lies in the fact that the passage section 4 is in this case not attached by overmolding on the holding section 2 and/or the wiper section 3, but that it has been inserted and attached subsequently, preferably by snap-locking.

Production thus takes place by a unit consisting of the wiper section and the holding section being first produced or injection-molded, which are interconnected via said webs. Depending on the thickness of these webs, larger or smaller windows, which are at first open, are found between the holding section and the distance section. These windows are closed by a sleeve, which forms the passage section, being pushed in from the side of the holding section. This sleeve preferably consists of metal, but can also consist of another material which is sufficiently rigid in itself even if it is thin-walled.

Snapping devices that snap-lock with the sleeve once it is in its final position are provided in the interior of the unit consisting of holding section and wiper section. In this case, the fact can be exploited that the holding section is fabricated from a soft elastic elastomeric material which expands in the circumferential direction when the conical sleeve is pushed in and which snaps back behind the edge of the sleeve, as is indicated in FIG. 4, when the sleeve reaches its final position. The sleeve can then be very easily pressed in from above using a stamp and simultaneously snap-locked automatically. Of course, alternative attaching methods are also possible, such as ultrasonic welding or the like.

The invention claimed is:

1. A wiper for wiping a cosmetics applicator upon withdrawing the cosmetics applicator from a storage chamber filled with a cosmetic to be applied, comprising:

a wiper section that rests against a stem of the cosmetics applicator substantially under flexional bias when the cosmetics applicator is inserted into the storage chamber;

a holding section for fixing the wiper on a storage container; and at least in some areas between the wiper section and the holding section, a functional section is disposed having a screen structure of several passage openings that are disposed immediately next to one another, which connects the storage chamber with a wiper antechamber;

wherein the section forming the screen structure comprises a different material from the wiper section or at least the part thereof producing the actual wiping effect.

2. The wiper according to claim 1, wherein a passage section is formed so thin-walled in the area thereof forming the screen structure that substantially no cosmetic mass can deposit in the passage openings.

3. The wiper according to claim 1, wherein a passage section is made from such a rigid material that the screen structure is substantially not deformed under the influence of forces occurring upon withdrawal of the applicator.

4. The wiper according to claim 1, wherein a passage section, or at least the screen structure formed by the passage section, consists of stainless steel.

5. The wiper according to claim 1, wherein a metal section with at least one passage opening in the shape of a metal sleeve is fitted between the wiper section and the holding section.

6. The wiper according to claim 1, wherein the screen structure comprises passage openings which are disposed in a circumferential direction along a joint center line one behind the other and/or disposed in a longitudinal direction along a joint center line one behind the other.

7. The wiper according to claim 1, wherein a passage section consists of an expanded metal shaped to form a sleeve.

8. The wiper according to claim 1, wherein the individual passage openings each have an opening cross-section whose surface area, with regard to its amount, corresponds to the surface area of a circle having a diameter of ≤3 mm.

9. The wiper according to claim 1, wherein passage openings disposed immediately next to one another in the circumferential or longitudinal direction are respectively separated from one another only by a very narrow web, namely a web whose surface area is smaller than the free cross-sectional surface area of a single passage opening.

10. The wiper according to claim 1, wherein the screen structure consists of the plurality of individual passage openings which are disposed immediately next to one another and separated only by webs, wherein the cross-sectional surface area of the passage openings and the dimensions of the webs are selected such that, if the cross-sectional surface areas GQF of the individual passage openings are added up and if the surface areas GSF are added up that the individual webs have on the side of the outer circumference, the total cross-sectional surface area GQF of the individual passage openings makes up 20% to 70% of the total surface area GSF of the individual webs.

11. A cosmetics unit, in the form of a mascara unit, comprising a storage container filled with a cosmetic, an applicator, which itself comprises a shaft protruding from a handle, the shaft carrying on its distal end an application member in the form of a brush, and a wiper controlling a single opening of the storage container, through whose wiper opening the shaft and the application member are moved in order to dip the application member into the supply of the cosmetic or withdraw it therefrom, wherein the wiper is a wiper according to claim 1.

* * * * *